US006607329B2

(12) United States Patent
Smith

(10) Patent No.: US 6,607,329 B2
(45) Date of Patent: Aug. 19, 2003

(54) METHOD OF FORMING, INSTALLING AND A SYSTEM FOR ATTACHING A PRE-FABRICATED PAVEMENT SLAB TO A SUBBASE AND THE PRE-FABRICATED PAVEMENT SLAB SO FORMED

(75) Inventor: Peter J. Smith, Gansevoort, NY (US)

(73) Assignee: The Fort Miller Co., Inc., Greenwich, NY (US)

( * ) Notice: Subject to any disclaimer, the term of this patent is extended or adjusted under 35 U.S.C. 154(b) by 0 days.

(21) Appl. No.: 10/005,925

(22) Filed: Dec. 7, 2001

(65) Prior Publication Data

US 2002/0037196 A1 Mar. 28, 2002

Related U.S. Application Data

(62) Division of application No. 09/655,129, filed on Sep. 5, 2000.

(51) Int. Cl.[7] ..... E01C 3/00

(52) U.S. Cl. ..... 404/29; 404/17; 404/34; 404/40; 52/600; 52/607; 52/596

(58) Field of Search ..... 404/102, 29, 18, 404/34, 39, 40, 41, 60, 31, 69, 17; 52/600, 596, 607, 601, 587.1, 585.1, 742.16

(56) References Cited

U.S. PATENT DOCUMENTS

| | | | | | |
|---|---|---|---|---|---|
| 850,948 | A | | 4/1907 | Mohr | |
| 1,660,421 | A | * | 2/1928 | Knight | 404/40 |
| 2,780,150 | A | | 2/1957 | Yeoman | |
| 3,152,421 | A | * | 10/1964 | Mittendorf | 425/111 |
| 3,746,458 | A | * | 7/1973 | Allocca | 404/37 |
| 3,765,783 | A | * | 10/1973 | Wager | 404/2 |
| 3,918,222 | A | * | 11/1975 | Bahramian | 29/452 |
| 3,969,851 | A | * | 7/1976 | Whitacre | 52/98 |
| 4,147,009 | A | * | 4/1979 | Watry | 264/228 |
| 4,239,176 | A | * | 12/1980 | Salazar | 249/97 |
| 4,296,798 | A | * | 10/1981 | Schramm | 126/629 |
| 4,305,680 | A | | 12/1981 | Rauchfuss, Jr. | |
| 4,353,666 | A | | 10/1982 | Brandley | |
| 4,432,175 | A | * | 2/1984 | Smith | 52/223.6 |
| 4,605,336 | A | | 8/1986 | Slaw, Sr. | |
| 4,640,073 | A | * | 2/1987 | Blecher | 52/126.6 |
| 4,958,964 | A | * | 9/1990 | Soto et al. | 404/40 |
| 4,972,537 | A | * | 11/1990 | Slaw, Sr. | 14/73 |
| 5,373,675 | A | * | 12/1994 | Ellison, Jr. | 52/320 |
| 5,443,324 | A | | 8/1995 | Sullivan | |
| 5,476,341 | A | * | 12/1995 | Johnson et al. | 404/101 |
| 5,957,619 | A | | 9/1999 | Kinoshita et al. | |
| 6,021,646 | A | * | 2/2000 | Burley et al. | 62/235 |
| 6,052,960 | A | | 4/2000 | Yonemura | |
| 6,101,779 | A | * | 8/2000 | Davenport | 52/223.6 |
| 6,122,890 | A | * | 9/2000 | Pollitt | 52/747.11 |

FOREIGN PATENT DOCUMENTS

| | | | | |
|---|---|---|---|---|
| DE | 03430319 A1 | * | 2/1986 | E01C/23/09 |
| JP | 0814198 A1 | * | 12/1997 | E01C/5/00 |
| JP | 410030204 A | * | 2/1998 | E01C/5/06 |
| WO | WO 9707303 | * | 2/1997 | E04F/21/20 |

* cited by examiner

*Primary Examiner*—J. J. Swann
*Assistant Examiner*—Katherine Mitchell
(74) *Attorney, Agent, or Firm*—Schmeiser, Olsen & Watts

(57) ABSTRACT

A pre-fabricated pavement slab having a binder distribution system and an interconnection system formed for attachment of the bottom surface of the slab, wherein both the binder distribution system and the interconnection system are accessible from the top surface of the slab, such that the binder material may be injected into the binder distribution and interconnection systems from the top surface of the slab.

10 Claims, 11 Drawing Sheets

METHOD OF FORMING, INSTALLING AND A SYSTEM FOR ATTACHING A PRE-FABRICATED PAVEMENT SLAB TO A SUBBASE AND THE PRE-FABRICATED PAVEMENT SLAB SO FORMED

This application is a divisional of Ser. No. 09/655,129, filed on Sep. 5, 2000.

BACKGROUND OF THE INVENTION

1. Technical Field

The present invention relates generally to roadway construction and repair, and more particularly, to the formation, installation and system for attaching a pre-fabricated pavement slab, and the slab so formed.

2. Related Art

Heretofore, attempts have been made to construct and install pre-fabricated or precast pavement slabs. However, most attempts have been relatively unsuccessful due to a combination of factors. For example, it is difficult to prepare and maintain a perfectly smooth sub-grade which is necessary to uniformly support the slab. Likewise, it is difficult to connect adjacent slabs in a manner that uniformly transfers shear loading from one slab to the next. Accordingly, there exists a need in the industry for a precast pavement slab and a method of installing the slab that solves these and other problems.

SUMMARY OF THE INVENTION

A first general aspect of the present invention provides a pre-fabricated pavement slab comprising: at least one connector extending from a first end of the slab; at least one mating interconnection formed within a second end thereof to receive the connector, wherein the interconnection is accessible from a top surface of the slab; and a plurality of channels formed within a bottom surface of the slab, wherein at least one channel is accessible from the top surface of the slab.

A second general aspect of the present invention provides a system for installation of a pre-fabricated pavement slab comprising: a binder distribution system formed for attachment of a bottom surface of the slab and accessible from a top surface of the slab; and an interconnection system along edges of the slab and accessible from the top surface of the slab.

A third general aspect of the present invention provides a method of installing a pre-fabricated pavement slab, comprising: placing the slab on a graded subbase; and uniformly distributing a binder material along a bottom surface of the slab via at least one access in a top surface of the slab.

A fourth general aspect of the present invention provides a method of forming a prefabricated pavement slab comprising: providing a form for forming binder distribution system within a bottom surface of the slab; pouring a pavement material into the form; and incorporating a plurality of interconnections within a first end of the slab.

A fifth general aspect of the present invention provides a device comprising: a first slab and a second slab, wherein the first and second slabs further comprise a binder distribution system formed within a bottom surface of the first and second slabs; and a shear transfer device between the first and second slabs.

The foregoing and other features of the invention will be apparent from the following more particular description of the embodiments of the invention.

BRIEF DESCRIPTION OF THE DRAWINGS

The embodiments of this invention will be described in detail, with reference to the following figures, wherein like designations denote like elements, and wherein.

DESCRIPTION OF THE PREFERRED EMBODIMENTS

Although certain embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc. Although the drawings are intended to illustrate the present invention, the drawings are not necessarily drawn to scale.

Figure 1:
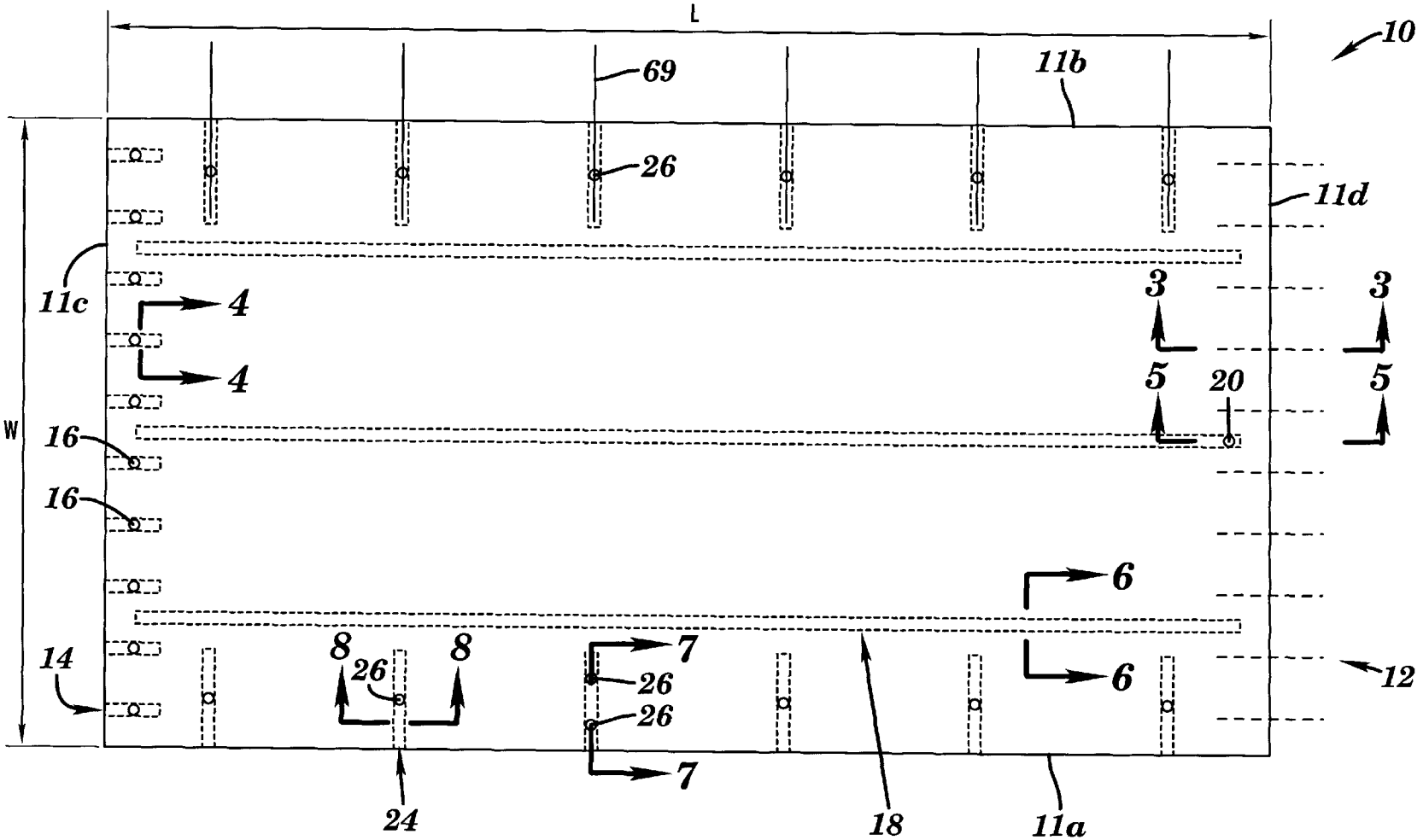
FIG. 1 depicts a plan view of a pre-fabricated pavement slab in accordance with the present invention.
Figure 15:
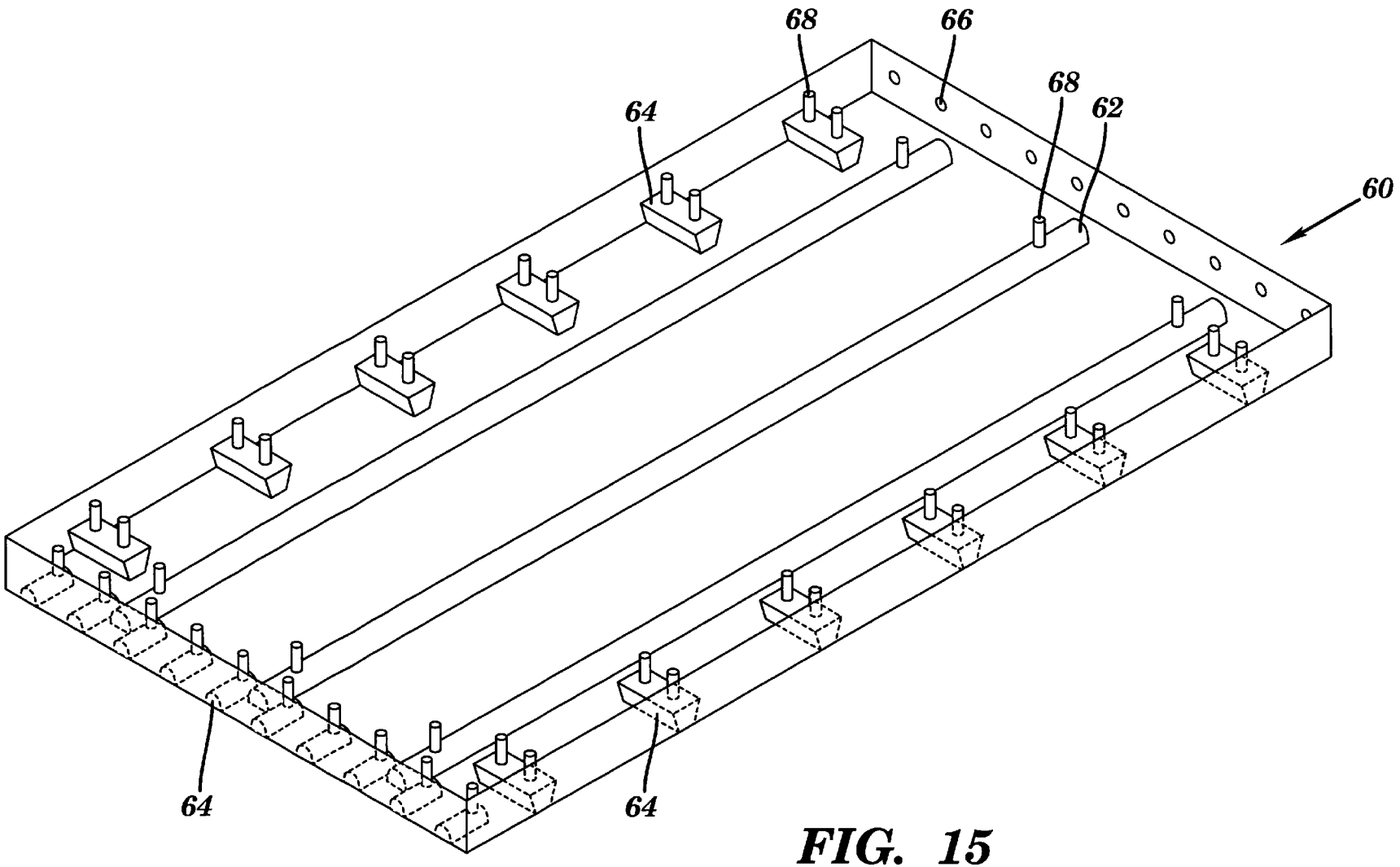
FIG. 15 depicts a form used to construct the slab in accordance with the present invention.

Referring to the drawings, FIG. 1 shows a plan view of a pre-fabricated pavement slab 10. The slab 10 may be constructed by pouring a pavement material, such as concrete, or other similarly used material, into a form 60, having a plurality of raised channel forming surfaces 62, raised slot forming surfaces 64, connector openings 66 and port forming surfaces 68 (refer to FIG. 15). The raised channel forming surfaces may be independent from the raised slot forming surfaces as shown in FIG. 15. The slab 10 may be used in high traffic areas, such as highways, on/off ramps, airport runways, toll booth areas, etc. The pavement slab 10 is approximately 10–12 feet (3.049–3.658 m) wide W, as required by the New York State Department of Transportation, and approximately 18 feet (5.486 m) in length L. The slabs 10 may range in thickness T from approximately 9–12 inches. These dimensions, L, W, T, however, may vary as desired, needed or required and are only stated here as an example.

Figure 2:
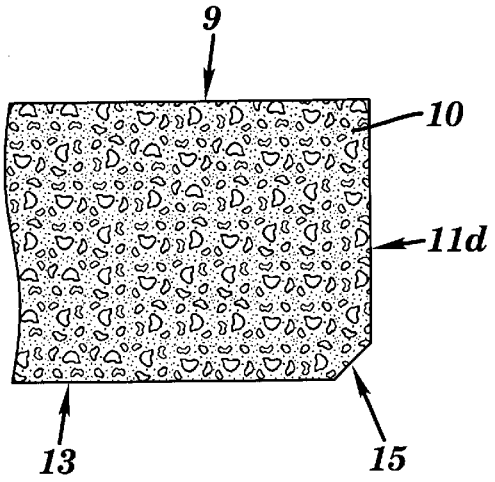
FIG. 2 depicts a cross-sectional view of the pre-fabricated pavement slab in accordance with the present invention.

The top surface 9 of the slab 10 is a roughened astroturf drag finish, while the sides 11*a* and 11*b*, the ends 11*c* and 11*d*, and bottom surface 13 of the slab 10 have a substantially smooth finish (refer to FIG. 2, which shows a cross-sectional view of a corner of the slab 10). The side 11*a* or the side 11*b* may be a first edge and the end 11*c* or the end 11*d* may be a second edge. The bottom surface 13, the sides 11*a* and 11*b*, and the ends 11*c* and 11*d* of the slab 10 come together to form a chamfer 15 around the perimeter of the slab 10. The chamfer 15 prevents soil build-up between two mating slabs which may occur if the slab 10 is tipped slightly during installation.

The slab 10 further includes a plurality of connectors 12 that may comprise transverse slippable connecting rods or dowels. The plurality of connectors may be embedded within a first end of the slab 10. In one embodiment, the connectors 12 are post tensioned interconnections, as known and used in the industry, wherein multiple slabs may be connected in compression. The connectors 12 are spaced approximately 1 ft. apart along the width W of the slab 10, and comprise steel rods, or other similar material conventionally known and used. Each connector 12 is of standard dimensions, approximately 14 inches in length and 1.25 inches in diameter. The slippable connectors 12 are mounted truly parallel to the longitudinal axis L of the slab 10 to allow adjacent slabs 10 to expand and contract without inducing unwanted damaging stresses in the slabs 10. The connectors 12 are preferentially mounted such that approximately half of the connector 12 is embedded within the pavement slab 10 and half of the connector 12 extends from the end of the slab 10.

Figure 3:
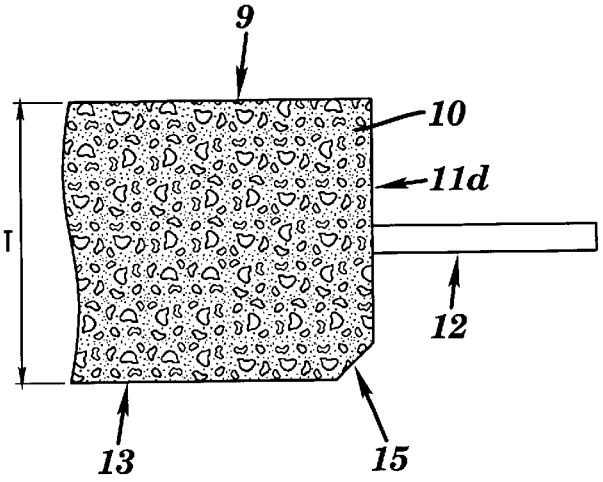
FIG. 3 depicts a cross-sectional view of a transverse dowel bar in accordance with the present invention.

FIG. 3 shows a cross-sectional view (along line 3—3 of FIG. 1) of the slab 10 and a connector 12 extending therefrom. As illustrated, the connectors 12 are embedded within a first end 11*d* of the slab 10 at approximately the midpoint of the thickness T of the slab 10. The connectors 12 aid in transferring an applied shear load, i.e., from traffic, evenly from one slab 10 to the adjacent slab, without causing damage to the slab 10.

Figure 4A:
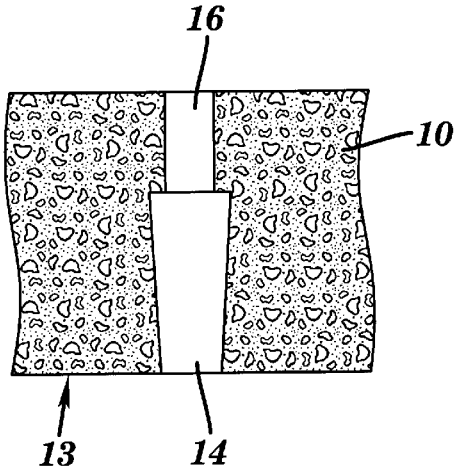
FIG. 4A depicts a cross-sectional view taken along line 4—4 of FIG. 1, of a connector slot in accordance with embodiments of the present invention.

The slab 10 further includes a plurality of inverted interconnection slots 14 formed within the bottom surface 13 of the slab 10 at a second end 11*c* thereof. Each interconnection slot 14 is sized to accommodate the connectors 12 extending from the end of an adjacent slab 10, thereby forming an interconnection between adjacent slabs once the slot 14 is filled around the connectors 12 with a binder material. FIG. 4A shows a cross-sectional view (along line 4—4 of FIG. 1) of an interconnection slot 14, wherein the slot 14 is wider at the top of the slot 14 than at the bottom of the slot 14. This wedged shape prevents the slab 10 from moving downward with respect to the adjacent slab with the application of a load once the binder material has reached sufficient strength.

Figure 4B:
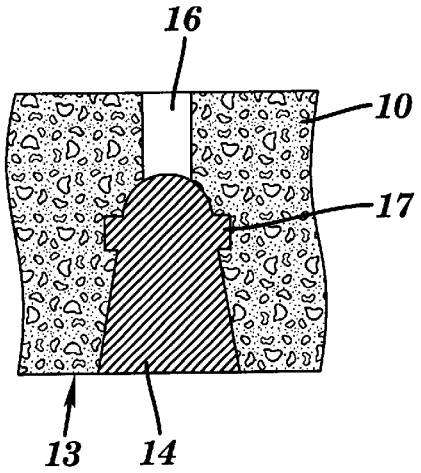
FIG. 4B depicts FIG. 4A using an alternative connector slot in accordance with embodiments of the present invention.
Figure 4C:
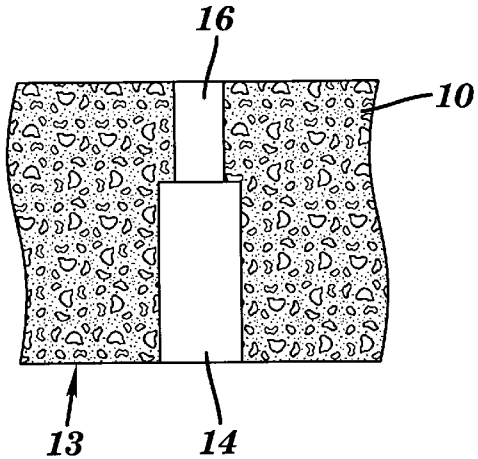
FIG. 4C depicts FIG. 4A using an alternative connector slot in accordance with embodiments of the present invention.

In the alternative, the interconnection slots 14 may take the form of a "mouse hole" having a pair of cut-outs or holes 17 formed on both sides thereof, as illustrated in FIG. 4B. In this case, when the slots 14 are filled with a binder material, the holes 17 form shear pins on the sides of the mouse hole that would have to be sheared in order for the slab 10 to move downward with respect to the adjacent slab. In the alternative, the slots 14 may have vertically oriented sides, as illustrated in FIG. 4C. In this case the sides of the slot 14 are sandblasted to provide a roughened surface, thereby frictionally limiting the ability of the slab 10 to move downward with respect to the adjacent slab.

As illustrated in FIGS. 4A–4C, each interconnection slot 14 further includes an opening, access or port 16. In particular, a binder material such as structural grout or concrete, a polymer foam material, or other similar material, may be injected within each port 16 thereby filling the interconnection slot 14 receiving the inserted connector 12 (not illustrated) to secure adjacent slabs end to end.

It has been previously noted that the connectors 12 are preferentially mounted as described above with approximately half of the connector 12 embedded in an adjacent slab while the other half is engaged and embedded in the interconnections slots 14 of slab 10. Alternatively, the same connector 12 may be preplaced on the subgrade, not shown, such that interconnections slots 14 in both slabs engage the connectors 12, such interconnection slots 14 being subsequently filled with binder material in the same manner described in the foregoing.

Figure 5:
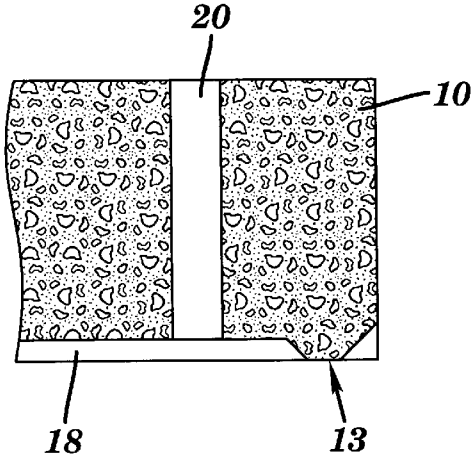
FIG. 5 depicts a cross-sectional view taken along line 5—5 of FIG. 1, of a channel in accordance with embodiments of the present invention.

The slab 10 further includes a plurality, in this example three, channels 18 running longitudinally along the length L of the slab 10. The channels 18 formed within the bottom surface 13 of the slab 10 facilitate the even dispersement of a bedding material, such as bedding grout or concrete, a polymer foam material, or other similar material, to the underside of the slab 10. As shown in FIG. 5, which depicts a cross-sectional view of the slab 10 (along line 5—5 of FIG. 1), each channel 18 includes a port 20 at each end of the channel 18 (one end shown in FIG. 5) . Each port 20 extends from the top surface 9 of the slab 10 to the channel 18, thereby providing access to the channel 18 from the top surface 9 of the slab 10. This facilitates the injection of bedding material beneath the bottom surface 13 of the slab 10 via ports 20 which are accessible from the top surface 9 after the slab 10 has been installed.

Figure 6:
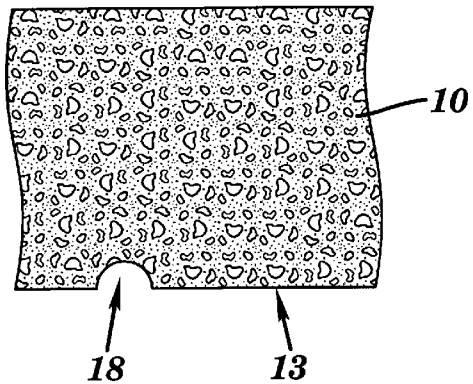
FIG. 6 depicts a cross-sectional view taken along line 6—6 of FIG. 1, of the channel in accordance with embodiments of the present invention.

As illustrated in FIG. 6, which shows a cross-sectional view of the channels 18 along a line 6—6 of FIG. 1, the channels 18 are in the shape of half round voids. The rounded shape aids in the uniform distribution of bedding material along the bottom surface 13 of the slab 10 to fill any gaps between the slab 10 and the subbase (not shown). In the alternative, the channels 18 may take other shapes, such as rectangles, etc. Furthermore, instead of using channels 18 to facilitate the even dispersement of the bedding material beneath the slab 10, a pipe system may be used. For instance, the pipe system (not shown) may comprise a plurality of pipes, approximately one inch in diameter, having holes or continuous slots formed therein.

Figure 7:
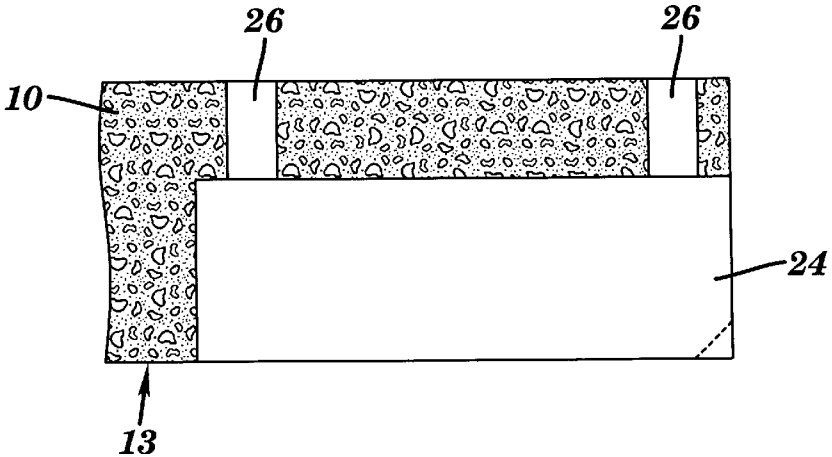
FIG. 7 depicts a cross-sectional view taken along line E—E of FIG. 1, of a connector slot in accordance with embodiments of the present invention.

The slab 10 further includes a plurality of interconnection slots 24, shown in this example within a first side 11*a* of the slab 10 (FIG. 1). The slots are illustrated more clearly in FIGS. 7 and 8A–8C. In particular, FIG. 7 shows a cross-sectional view of an interconnection slot 24 taken along a line 7—7 of FIG. 1. As illustrated, each interconnection slot 24 comprises a pair of openings, accesses or ports 26 at each end of the slot 24 which extend from the top surface 9 of the slab 10 to the interconnection slot 24 thereunder.

Figure 13A:
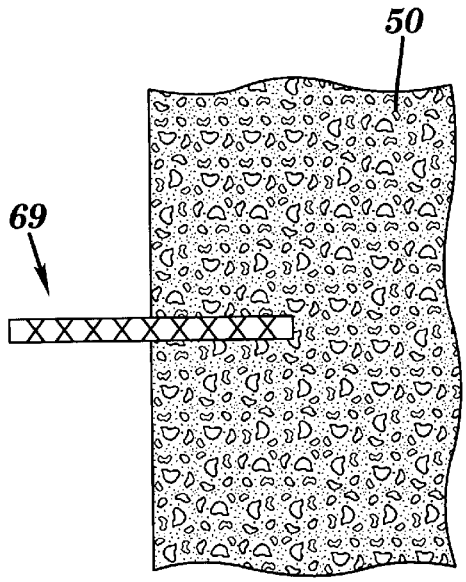
FIG. 13A depicts a cross-sectional view of a connector and an existing slab in accordance with embodiments of the present invention.
Figure 13B:
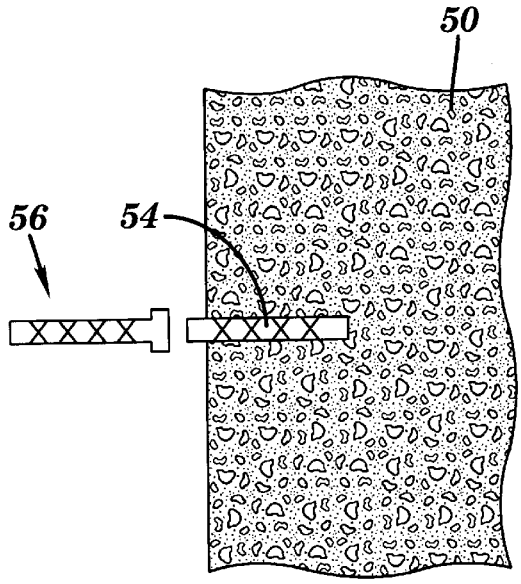
FIG. 13B depicts a cross-sectional view of a two piece connector and an existing slab in accordance with embodiments of the present invention.

The slab 10 further includes a plurality connectors 69 that may comprise, longitudinal connectors, non-slippable connecting rods, or dowels embedded within a second side 11*b* of slab 10 along the length L of the slab 10. As with the connectors 12, the connectors 69 may be post tensioned interconnections. The connectors 69 may be one-piece, where approximately half of the connector 69 is embedded within the pavement slab 10 and half of the connector 69 extends from the second side 11*b* of the slab 10. Alternatively, the connector 69 may be of a two-piece design comprising a first connector 54 and a second connector 56 as shown in FIG. 13B. The two-piece design would be used if it is desirable to keep shipping width of slab 10 to a minimum.

Figure 8A:
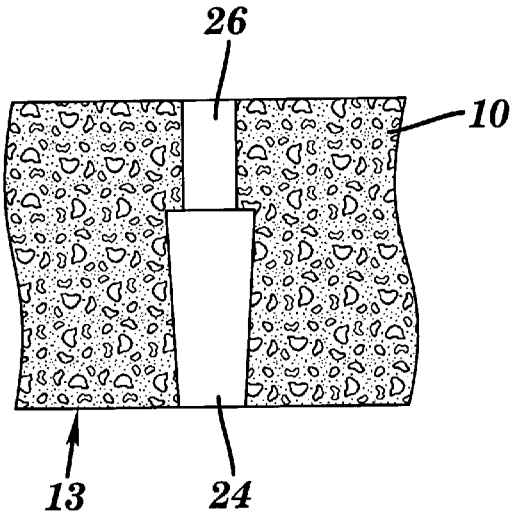
FIG. 8A depicts a cross-sectional view taken along line 8—8 of FIG. 1, of a connector slot in accordance with embodiments of the present invention.
Figure 8B:
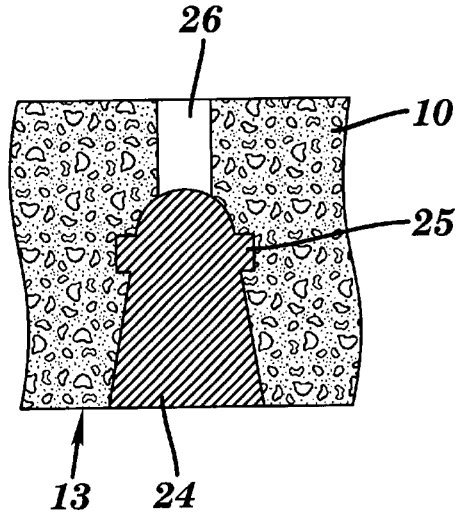
FIG. 8B depicts FIG. 8A using an alternative connector slot in accordance with embodiments of the present invention.
Figure 8C:
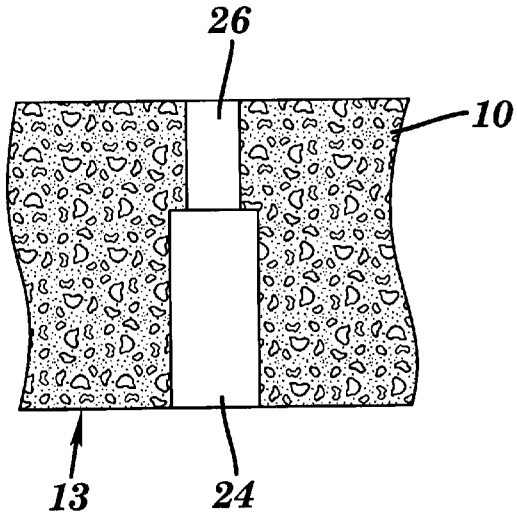
FIG. 8C depicts FIG. 8A using an alternative connector slot in accordance with embodiments of the present invention.

FIG. 8A depicts a cross-sectional view of the interconnection slot 24 and port 26 along line 8—8 of FIG. 1. Similar to the interconnection slots 14 along the ends 11 *c* and 11*d* of the slab 10 (shown in FIGS. 4A–4C), the interconnection slots 24 along the sides 11*a* and 11*b* of the slab 10 may alternatively take the form of a mouse hole 24 having cut-outs or holes 25 (FIG. 8E), or a slot 24 having vertically oriented sandblasted sides (FIG. 8C). The interconnection slots 24 receive connectors 69 that may comprise non-slippable connecting rods or dowels located within and extending from an adjacent new slab 10 or from an existing slab 50, such has been described embedded in the second side 11*b* of slab 10.

After the slab has been installed and the connectors are in their final location, a binder material, such as structural cementbased grout, a polymer foam, etc., is then injected into the interconnection slots 24, having the rods inserted therein, from the top surface 9 of the slab 10 via the ports 26. This aids in rigidly interconnecting adjacent slabs of the roadway and facilitates a relatively even load transfer between lanes.

Figure 9:
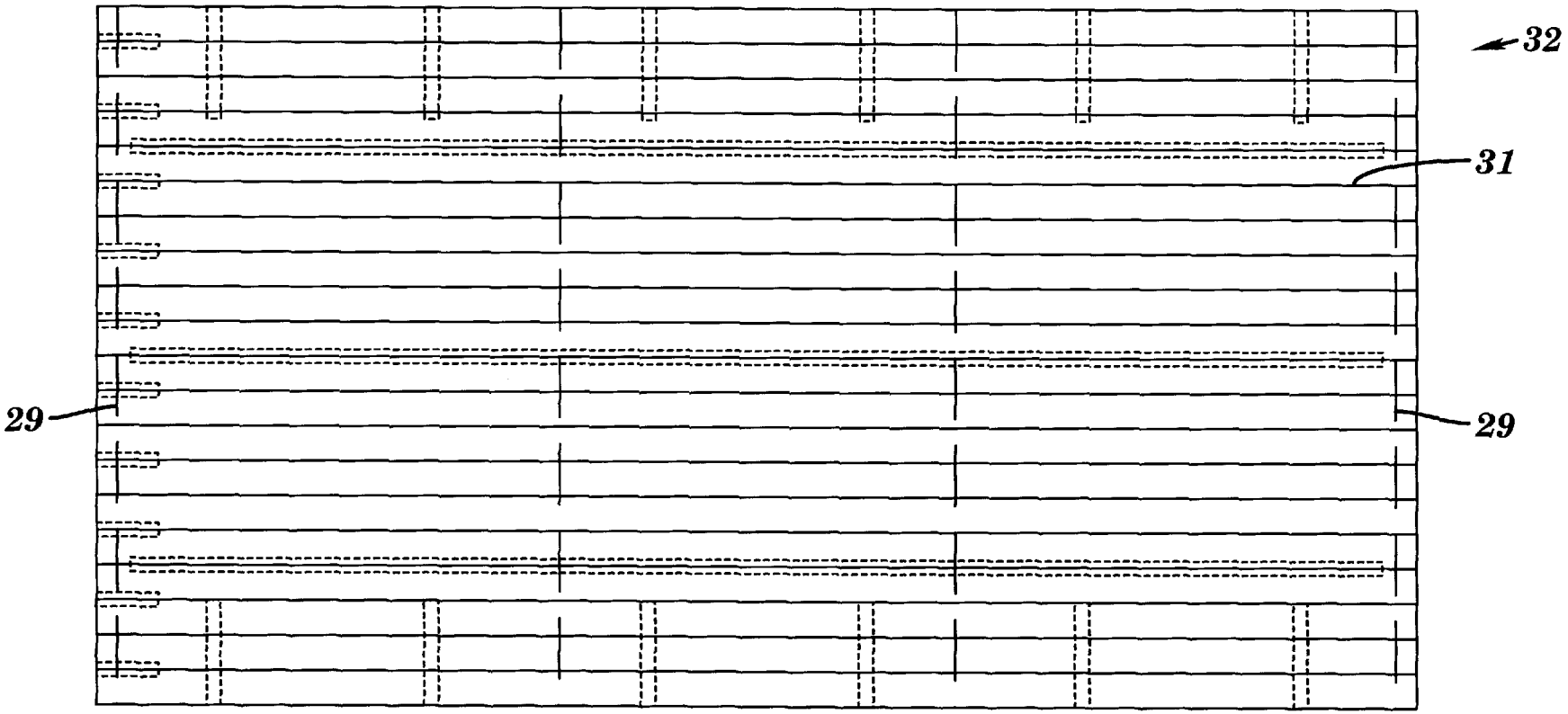
FIG. 9 depicts a top mat in accordance with the present invention.
Figure 10:
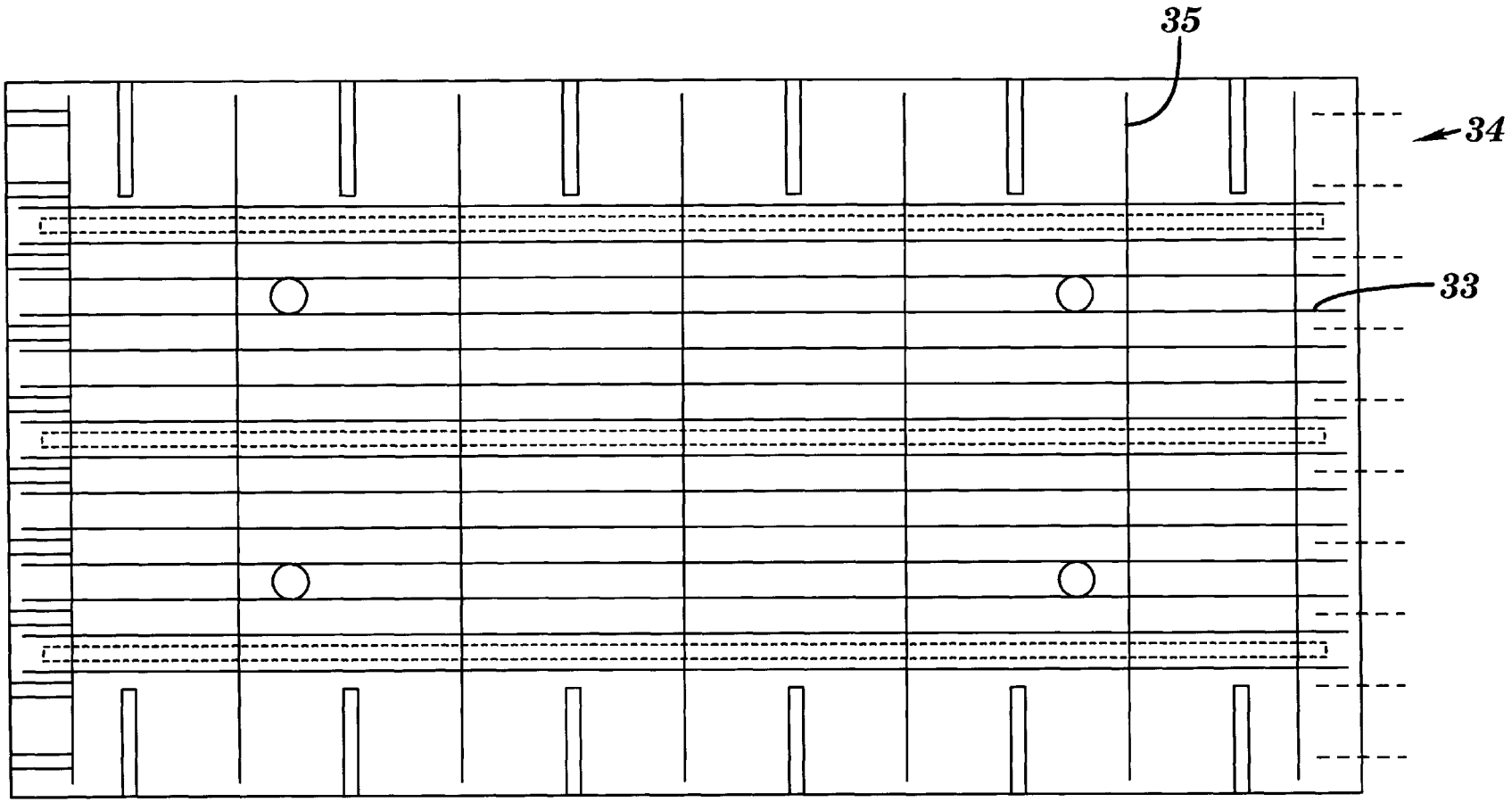
FIG. 10 depicts a bottom mat in accordance with the present invention.

The slab 10 further includes a top mat 32 and a bottom mat 34 (FIGS. 9 and 10, respectively). Both mats 32, 34 comprise reinforcing bars, or in the alternative reinforced steel mesh. The top mat 32, comprising longitudinal bars 31 and at least two transverse or cross bars 29, is formed within the slab 10 substantially near the top surface 9 of the slab 10. The top mat 32 prevents the slab 10 from "curling" or bending at the edges as a result of cyclic loading produced by temperature differentials. Likewise, the bottom mat 34 comprises longitudinal bars 33 and transverse or cross bars 35 formed within the slab 10 substantially near the bottom surface 13 of the slab 10. The bottom mat 34 provides the slab 10 with additional reinforcement and stability during handling.

Figure 11:
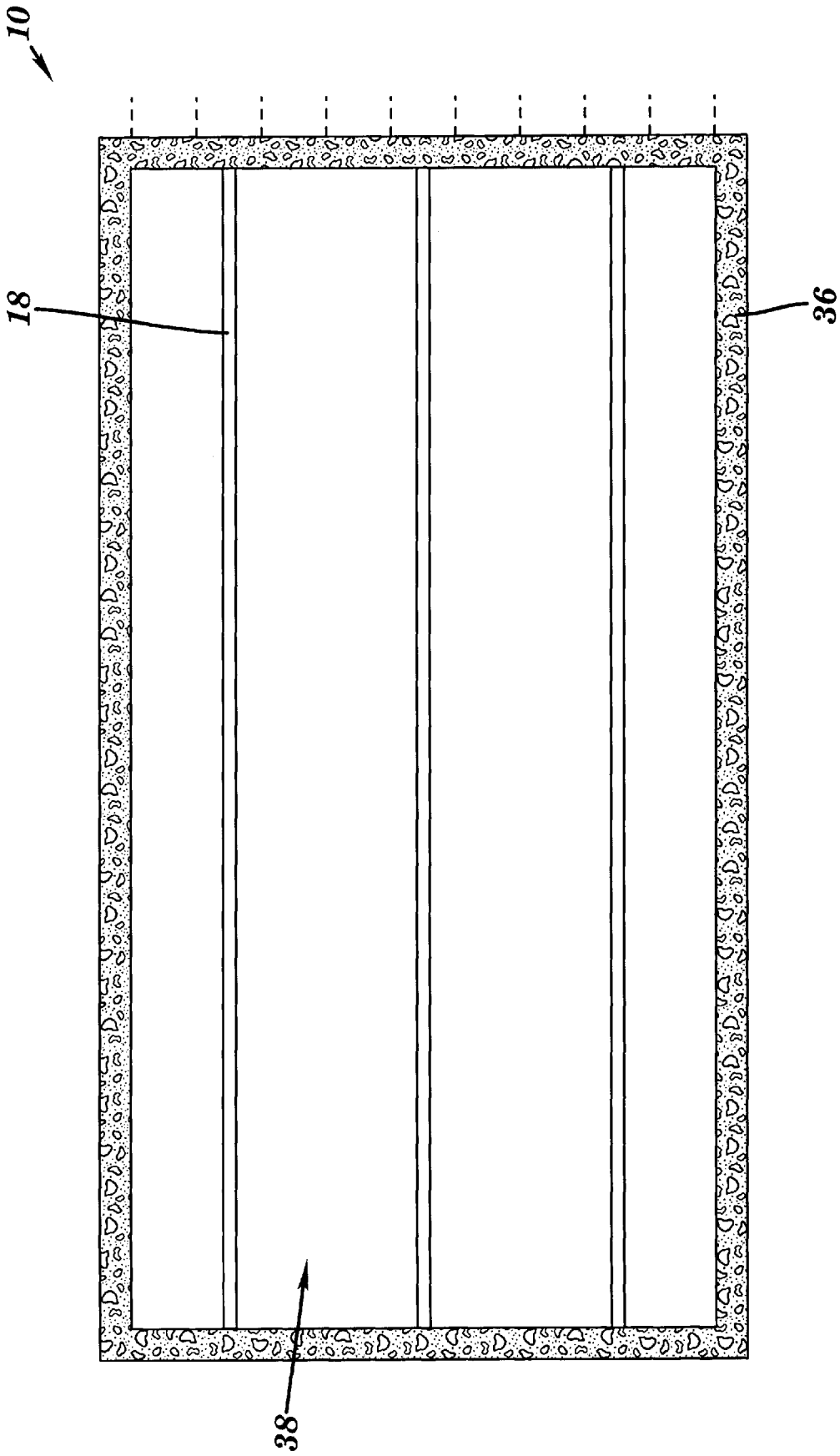
FIG. 11 depicts a gasket in accordance with the present invention.

A seal or gasket 36, comprising a compressible closed cell foam material, such as neoprene foam rubber or other similar material, is attached to the bottom surface 13 of the slab 10 around the perimeter of the slab 10, as illustrated in FIG. 11. The gasket 36 is approximately 12 mm thick and 25 mm wide, and is soft enough to fully compress under the weight of the slab 10. The gasket 36 forms a chamber or cavity 38 thereby sealing the boundary of the slab 10. This allows for the application of pressure to the bedding material during installation to ensure that all voids between the bottom surface 13 of the slab 10 and the subbase are filled.

Figure 12:
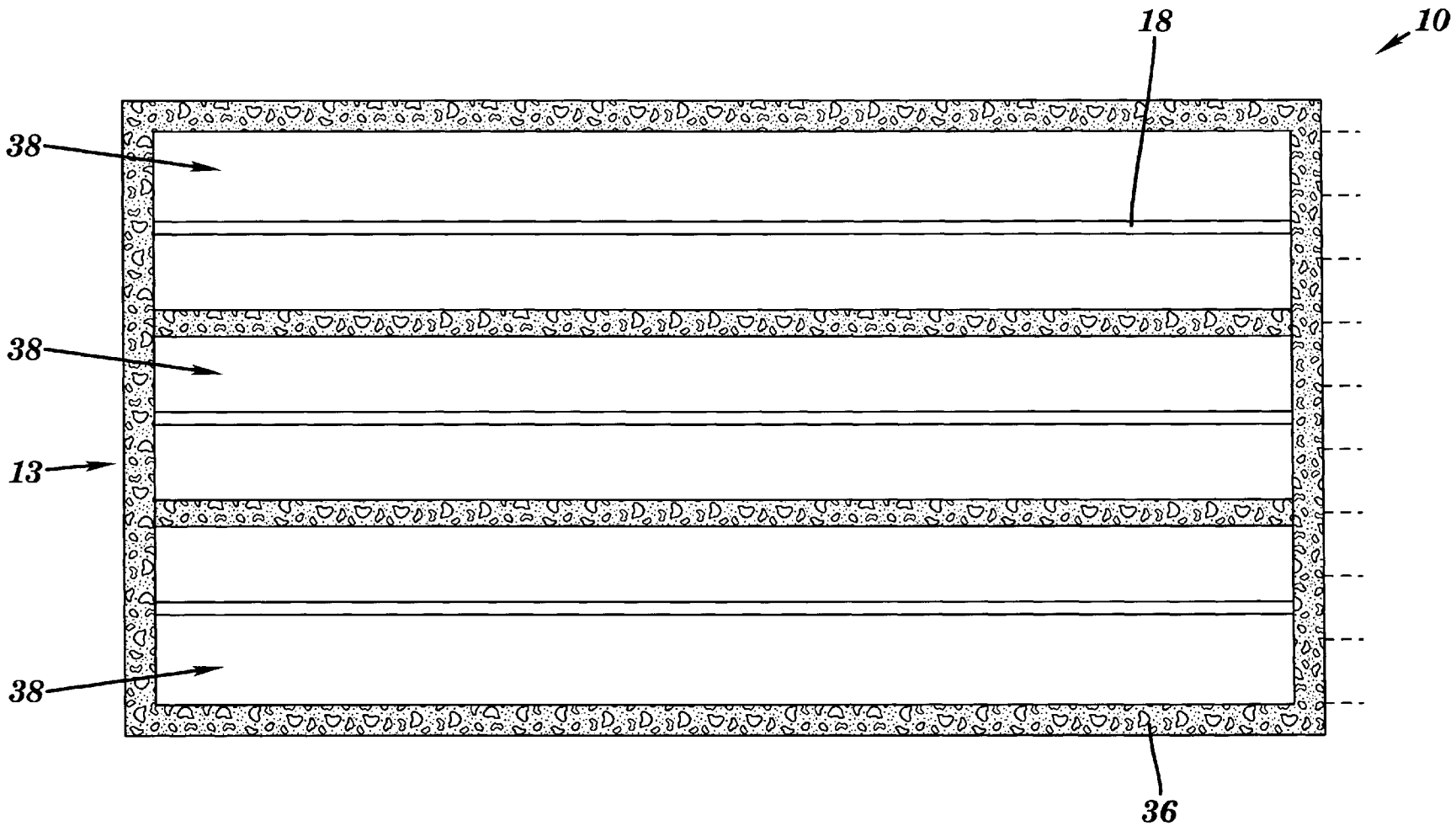
FIG. 12 depicts FIG. 11 using additional sections of a gasket in accordance with embodiments of the present invention.

Optionally, additional sections of the gasket 36, having the same or similar width and thickness, may be applied to the bottom surface 13 of the slab 10 to form a plurality of individual chambers or cavities 38, as illustrated in FIG. 12. The additional sections of the gasket 36 forming the cavities 38 reduce the amount of upward pressure exerted on the slab 10 during the injection of the bedding material as compared to that experienced by the slab 10 using one large sealed cavity (as illustrated in FIG. 11). Forming at least 3 to 4 cavities 38 effectively reduces the lift force produced from below the slab 10 as the bedding material is being forced thereunder.

To install the slab 10, connectors 12 may first need to be installed along the transverse end of an existing slab 50 and connectors 69 may need to be installed along the longitudinal side of the existing slabs 50, to match interconnection slots 14 and 24, respectively. If so, a hole may be drilled within the existing slab 50, using carbide tipped drill bits, or other similar tools. Thereafter, the connector 12 or the connector 69 is inserted within each hole, along with a binder material, such as a cement-based or epoxy grout, polymer foam, etc., such that approximately one half of the connector 12 or the connector 69 extends therefrom, as illustrated in FIGS. 3 and 13A, respectively. Slab 10 and existing slab 50 may be the same structurally and both slab 10 and existing slab 50 may have interconnect slots and/or connectors.

Figure 13C:
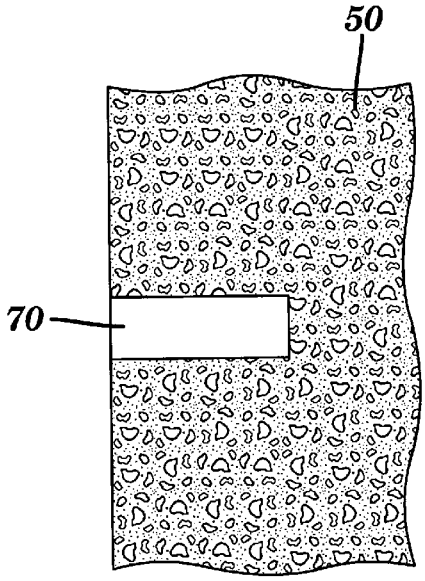
FIG. 13C depicts a plan view of a slot cut in an existing slab in accordance with the present invention.
Figure 13D:
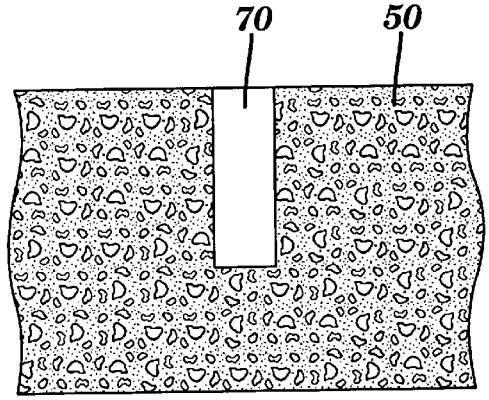
FIG. 13D depicts a cross-sectional view of a slot cut in an existing slab in accordance with the present invention.

Alternatively to installing connectors 12 and connectors 69 in the existing slab to mate with the interconnection slots 14 and 24 in the slab 10, the same connectors 12 and connectors 69 may be embedded in the slab 10 such that they extend from the slab 10 as described above. In this case, a vertical slot 70 is cut in the existing slabs 50 using a diamond blade concrete saw, or other similar tool, in locations corresponding to the extended connectors 12 and connectors 69 in slab 10 (refer to FIGS. 13C and 13D). The sawing operation would be done ahead of the slab 10 installation operation. The slots 70 would be opened up and burrs removed using a light-weight pneumatic chipping hammer, or other similar tool. This option would be chosen to avoid the above described drilling process that should be done during the night-time grading operation.

In preparation for slab installation, the replacement area (the area in which the slab 10 will be placed) is cleaned of all excess material to provide a subbase or sub-grade approximately 25 mm below the theoretical bottom surface 13 of the slab 10. The subbase is graded with conventional grading equipment such as a grader, skid steer loader, etc., and fully compacted with a vibratory roller or other similar device. The compacted subgrade is subsequently overlaid with approximately 30 mm of finely graded material such a stone dust that can be easily graded with the precision grading equipment described below.

Figure 14:
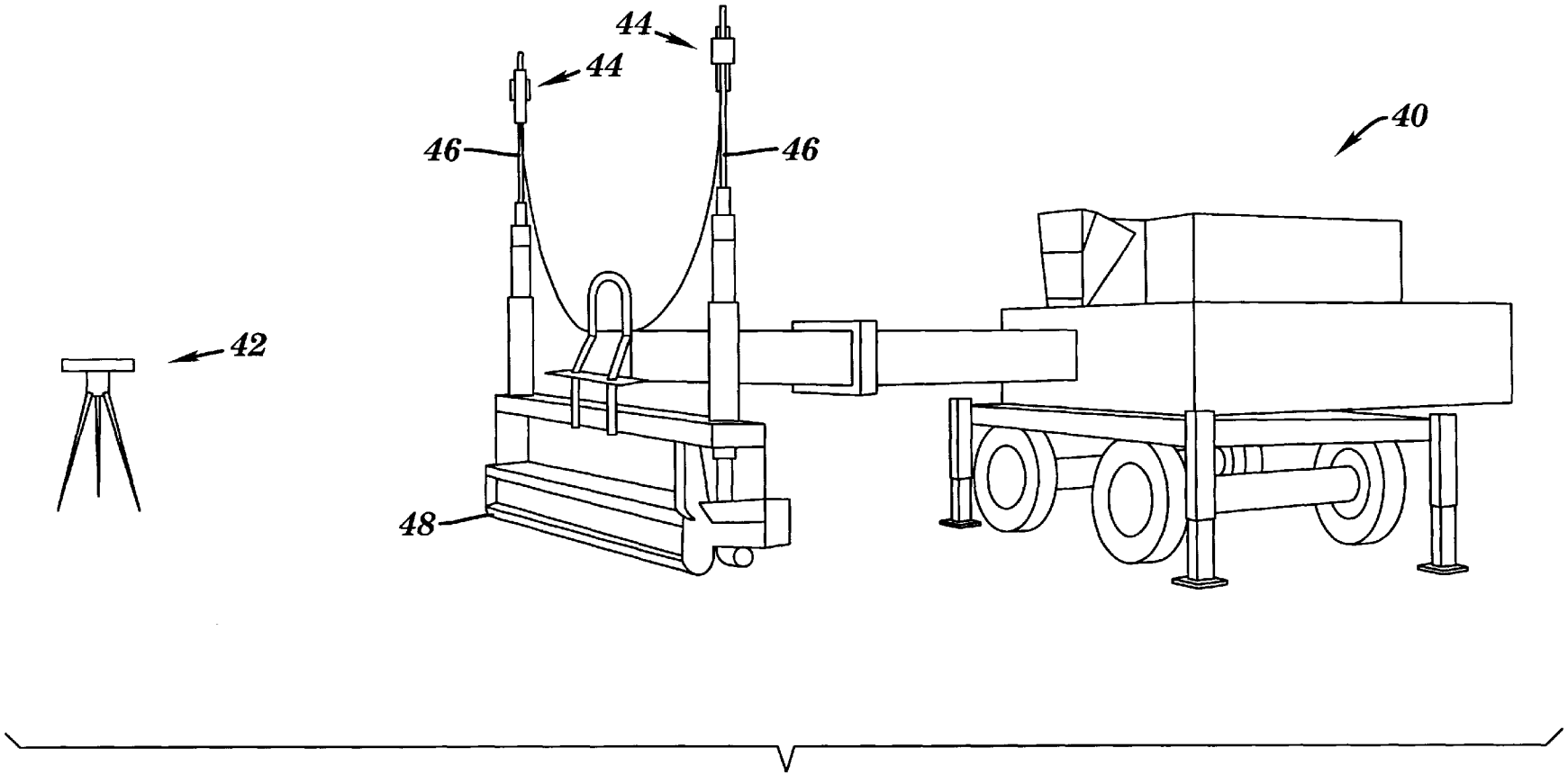
FIG. 14 depicts a grading device used in accordance with the present invention.

The stone dust is then graded with a conventional screening device or a laser-controlled screeding device, such as the Somero Laser Screed™ (Somero Enterprises of Jafrey, N.H.), as illustrated in FIG. 14. The Somero Laser Screed™ is controlled by a rotating laser beam that is continuously emitted by a laser transmitter 42, located at a remote location and at least 6–8 feet above ground level. The transmitter is adjusted to emit a beam of unique cross-slope and grade corresponding to the plane required for the slab 10. The cross-slope allows for water runoff and the grade represents the longitudinal slope required for vertical alignment of the roadway.

For straight highways, where the cross-slope and the grade are constant, the rotating laser beam set as described above will serve to set multiple slabs. For both horizontally and vertically curved highways the rotating laser beam will have to be set to a distinct plane for each slab. This continuous adjustment may be done manually or automatically with software designed for that specific purpose. Alternatively, the screed may by controlled by other electronic means unique to the Somero Laser Screed™.

Specific to the Somero Laser Screed™, laser receivers 44, mounted on posts 46 above the screed 48, receive and follow the theoretical plane emitted from the transmitter 42 as the grading screed 48 is pulled over the replacement area. After the first grading pass, the stone dust layer is fully compacted with a vibratory roller or other similar device and a second grading pass is made in which the subbase is brought to within $1/16^{th}$ of an inch (or "Super-graded") of the required theoretical plane. After super-grading has been completed, the stone dust layer is dampened with water, as needed for the subsequent grouting process, in final preparation for installation of the slab 10.

The slab 10 is placed within the replacement area such that the slab 10 contacts the subbase uniformly so as not to disrupt the subbase or damage the slab 10. During placement, the slab 10 is lowered vertically to the exact location required to match the existing adjacent slabs 50. Care is taken to insure the interconnection slots 14 and 24, within the sides and end (if an adjacent slab 50 is present at the end of the slab 10) of the slab 10 are lowered over the connectors 12 and connectors 69 extending from the ends and sides of the adjacent slabs 50 respectively. In the case where connectors 12 and connectors 69 extend from the slab 10, the slab 10 is also lowered vertically and carefully to insure the connectors 12 and connectors 69 are set within the slots 70 of the adjacent existing slabs 50. At this time, the slab 10 should be within 6+/−mm of the theoretical plane emitted from the rotating laser transmitter 42. In the event the surface 9 of the slab 10 is out of the required tolerance it is planed with a conventional diamond grinder until it is brought within tolerance.

The interconnection slots 14, 24 or 70, as the case may be are filled from the top surface 9 of the slab 10 with a binder material such as structural grout, or in the alternative, a polymer foam material, thereby fastening the slab 10 to the connectors 12, 54, 56, 69 or the slot 70 of the adjacent existing slabs 50. In particular, the binder material is injected under pressure into a first port 16, 26 of the interconnection slots 14, 24, respectively, until the binder material begins to exit the port 16, 26 at the other end of the interconnection slot 14, 24. It is desirable for the binder material within the slots 14, 24 to reach sufficient strength to transfer load from one slab to the other before opening the slab 10 to traffic.

The chamber(s) 38 formed by the gasket 36 on the bottom surface 13 of the slab 10 is/are then injected from the top surface 9 of the slab 10 with bedding material, such as grout including cement, water and fly ash, or in the alternative with a polymer foam material. In particular, starting from the lowest or downhill region, bedding material is injected into the port 20 at one end of the channel 18 until the bedding material begins to exit the port 20 at the other end of the channel 18. The bedding material is injected into the channels 18 to ensure that all voids existing between the bottom surface 13 of the slab 10 and the subbase, regardless of size, are filled. The slab 10 should be monitored during injection of the bedding material to ensure the slab 10 is not vertically displaced due to the upward pressure created thereunder. It is desirable for the bedding material under the slab 10 to reach a minimum strength of approximately 10.3 MPa before opening the slab 10 to traffic.

It should be noted that due to the precision of the Super Graded subbase, the channels 18 may not need to be filled prior to exposure of the slab 10 to traffic. Rather, the channels 18 may be filled within 24–48 hours following installation of the slab 10 without damaging the slab 10 or the subbase. This is particularly useful due to time constraints.

While this invention has been described in conjunction with the specific embodiments outlined above, it is evident that many alternatives, modifications and variations will be apparent to those skilled in the art. Accordingly, the embodiments of the invention as set forth above are intended to be illustrative, not limiting. Various changes may be made without departing from the spirit and scope of the invention as defined in the following claims.

I claim:

1. A system for installation of a pre-fabricated pavement slab comprising:

an interconnection system along edges of the slab and accessible from a top surface of the slab, wherein the interconnection system includes at least one interconnection slot, wherein the interconnection system further comprises:

a plurality of reinforcement bars extending from a first end of the slab;

a plurality of the at least one interconnection slots formed within the bottom of the slab at a second end thereof; and a plurality of at least one interconnection slots formed within the bottom of the slab at a first and second side thereof; and a binder distribution system formed for attachment of a bottom surface of the slab, wherein the binder distribution system includes at least one channel that is independent from and not parallel with the at least one interconnection slot, and wherein at least one port extends from the at least one interconnection slot to the top surface of the slab and at least one port extends from the at least one channel to the top surface of the slab.

2. The system of claim 1, wherein the interconnection slots comprise inverted holes having rounded tops and at least one shear pin formed along side of the holes.

3. A system for installation of a pre-fabricated pavement slab comprising:

a binder distribution system formed for attachment of bottom surface of the slab and accessible from a top surface of the slab; and an interconnection system along edges of the slab and accessible from the top surface of the slab, wherein the interconnection system comprises:

a plurality of reinforcement bars extending from a first end of the slab;

a plurality of mating interconnection slots formed within the bottom of the slab at a second end thereof; and a plurality of interconnection slots formed within the bottom of the slab at a first and second side thereof, wherein the interconnection slots comprise inverted holes having rounded tops and at least one shear pin formed along side of the holes.

4. The system of claim 1, wherein the interconnection slots comprise inverted holes having substantially vertically oriented sides, wherein the vertically oriented sides have a roughened surface.

5. A system for installation of a pre-fabricated pavement slab comprising:

an interconnection system along edges of the slab and accessible from a top surface of the slab, wherein the interconnection system includes at least one interconnection slot;

a binder distribution system formed for attachment of a bottom surface of the slab, wherein the binder distribution system includes at least one channel that is independent from and not parallel with the at least one interconnection slot, and wherein at least one port extends from the at least one interconnection slot to the top surface of the slab and at least one port extends from the at least one channel to the top surface of the slab; and a gasket formed along a perimeter of the bottom surface of the slab.

6. The system of claim 5, wherein the gasket forms a plurality of chambers on the bottom surface of the slab.

7. A system for installation of a pre-fabricated pavement slab comprising:

an interconnection system along edges of the slab and accessible from a top surface of the slab, wherein the interconnection system includes at least one interconnection slot;

a binder distribution system formed for attachment of a bottom surface of the slab, wherein the binder distribution system includes at least one channel that is independent from and not parallel with the at least one interconnection slot, and wherein at least one port extends from the at least one interconnection slot to the top surface of the slab and at least one port extends from the at least one channel to the top surface of the slab; and a reinforcement mat formed within the slab substantially near the top surface of the slab.

8. A system for installation of a pre-fabricated pavement slab comprising:

an interconnection system along edges of the slab and accessible from a top surface of the slab, wherein the interconnection system includes at least one interconnection slot; and a binder distribution system formed for attachment of a bottom surface of the slab, wherein the binder distribution system includes at least one channel that is independent from and not parallel with the at least one interconnection slot, and wherein at least one port extends from the at least one interconnection slot to the top surface of the slab and at least one port extends from the at least one channel to the top surface of the slab; and a reinforcement mat formed within the slab substantially near the bottom surface of the slab.

9. A system for installation of a pre-fabricated pavement slab comprising:

an interconnection system along edges of the slab and accessible from a top surface of the slab, wherein the interconnection system includes at least one interconnection slot, further wherein the interconnection system is post tensioned; and a binder distribution system formed for attachment of a bottom surface of the slab, wherein the binder distribution system includes at least one channel that is independent from and not parallel with the at least one interconnection slot, and wherein at least one port extends from the at least one interconnection slot to the top surface of the slab and at least one port extends from the at least one channel to the top surface of the slab.

10. A system for installation of pre-fabricated pavement slabs comprising:

at least one pavement slab, wherein the at least one pavement slab comprises a first interconnection on a first side for attachment of the first side of the slab and a second interconnection on a second side for attachment of the second side of the slab, and wherein one of the first interconnection and the second interconnection comprises a slot wherein a width of the slot on an exterior surface of the slab is narrower than a width of the slot at an interior portion of the slot.

* * * * *

UNITED STATES PATENT AND TRADEMARK OFFICE

CERTIFICATE OF CORRECTION

PATENT NO. : 6,607,329 B2
DATED : August 19, 2003
INVENTOR(S) : Peter J. Smith

It is certified that error appears in the above-identified patent and that said Letters Patent is hereby corrected as shown below:

Column 8,
Lines 50-52, delete claim 2 and replace with the following:
2. The system of claim 1, wherein the at least one interconnection slot comprises an inverted opening having a top width greater than a base width.

Signed and Sealed this

Twentieth Day of April, 2004

JON W. DUDAS
*Acting Director of the United States Patent and Trademark Office*